United States Patent [19]

Zeitel et al.

[11] Patent Number: 4,655,030

[45] Date of Patent: Apr. 7, 1987

[54] SIDE-FOLDING PACKER FOR SOFT CIGARETTE PACKS

[75] Inventors: Joachim Zeitel, Hagen; Horst Hedtstück, Gevelsberg, both of Fed. Rep. of Germany

[73] Assignee: Maschinenfabrik Alfred Schermund, Gevelsberg, Fed. Rep. of Germany

[21] Appl. No.: 830,634

[22] Filed: Feb. 18, 1986

[30] Foreign Application Priority Data

Feb. 19, 1985 [DE] Fed. Rep. of Germany ..... 3505620

[51] Int. Cl.[4] ..... B65B 9/20; B65B 49/08

[52] U.S. Cl. ..... 53/456; 53/466; 53/229; 53/575

[58] Field of Search ..... 53/452, 466, 444, 575, 53/229, 220, 148, 456

[56] References Cited

U.S. PATENT DOCUMENTS

| | | | |
|---|---|---|---|
| 3,412,525 | 11/1968 | Heinzer | 53/229 |
| 3,589,100 | 6/1971 | Konars | 53/229 X |
| 3,643,396 | 2/1972 | Togashi et al. | 53/229 X |
| 4,044,528 | 8/1977 | Black et al. | 53/575 |
| 4,100,718 | 7/1978 | Focke et al. | 53/575 X |
| 4,208,854 | 6/1980 | Seragnoli | 53/575 |
| 4,241,564 | 12/1980 | Quarenghi | 53/575 |

*Primary Examiner*—Horace M. Culver

*Attorney, Agent, or Firm*—Prutzman, Kalb, Chilton & Alix

[57] ABSTRACT

A method and apparatus for use in the packaging of cigarettes which eliminates interior package edges which interfere with reinsertion into a cigarette package of partially withdrawn cigarettes. The creation of interfering internal edges if avoided by employment of a novel technique for the folding of the package inner wrapper about a block of cigarettes.

10 Claims, 6 Drawing Figures

SIDE-FOLDING PACKER FOR SOFT CIGARETTE PACKS

BACKGROUND OF THE INVENTION (1) Field of the Invention

The present invention relates to packaging and particularly to the folding of sheet material into a wrapper which has no internal edges for interference with insertion of the product being wrapped. More specifically, this invention is directed to packaging machines or stations which receive and fold sheet material around an item, a pre-formed block of cigarettes for example, to be wrapped in a rapid and efficient manner. Accordingly, the general objects of the present invention are to provide novel and improved methods and apparatus of such character.

(2) Description of the Prior Art

While not limited thereto in its utility, the present invention is particularly well-suited for use in the formation of "soft" cigarette packages and particularly as part of a "side-folding" packaging station for forming a sheet of material into an inner wrapper which extends about a pre-formed group or block of cigarettes. It has, for many years, been common practice in the cigarette industry to form an inner wrapper for a "soft" cigarette package by means of apparatus known as a "side-folding packer". The manner of operation of such "side-folding packers" is such that, after an end of the package has been formed from a sheet of packaging material, tabs which result from the formation of the package end are folded inwardly. Subsequently, the sides the package are folded over the tabs. The resulting inner wrapper of the cigarette package is thus characterized by interior edges or ridges, defined by the end edge of a tab, which extend across the narrow sides of the rectangular package.

It is common practice for a "soft" cigarette package to be opened by removing the inner and outer wrappers in a portion of on end to thus allow access to the interior of the package. The portion of the wrappers removed will typically be sufficiently large to expose the ends of several cigarettes. The smoker will extract a cigarette from the package by producing impacts on the closed end and such impacts will usually result in several cigarettes being partially ejected. Those of the partially ejected cigarettes which are not to be used at that time must therefore be pushed back into the package. During this reinsertion, the cigarettes being pushed back into the package may "hang up" on one of the aforementioned interior edges and become damaged either due to breaking because of the application of excess force in the insertion direction or because of tearing of the cigarette paper.

SUMMARY OF THE INVENTION

The present invention overcomes the above-briefly discussed and other deficiencies and disadvantages of the prior art by providing a novel and unique technique for the formation of an interior wrapper of a "soft" cigarette package from sheet material which eliminates the interior edges which have characterized previous inner wrappers. The present invention also encompasses apparatus, namely a unique side-folding packaging machine, which is employed in the practice of this novel method.

In accordance with the present invention, after the bottom region of a rectangular package or inner wrapper has been defined on a sheet of wrapper paper, the wider sides of the package are formed by folding. Next, inner side walls are folded out of one of the wide sides. Subsequently, the lateral tabs, which extend from the package bottom region and result from the previously performed folding steps, are folded against the inner sidewalls. Finally, outer sidewalls are folded over the tabs and against the inner sidewalls, these outer sidewalls being formed from the other of the wider sides of the package. The above steps result in the tabs, which in prior art packages defined interfering interior edges, being sandwiched between inner and outer sidewalls or panels of the package.

Apparatus for performing the method briefly described above is capable of high-volume production, i.e., a high overall packaging speed, even though the bottom edges of the package are formed when the sheet material and block of cigarettes is virtually at a standstill, thereby permitting an exact angular arrangement of the various flaps to be obtained, and even though the conveyor system which delivers the product to the packaging station is driven continuously. Apparatus in accordance with the present invention is also characterized by an uncomplicated construction which enhances its reliability while minimizing its initial cost.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE DISCLOSED EMBODIMENT

Figure 3:
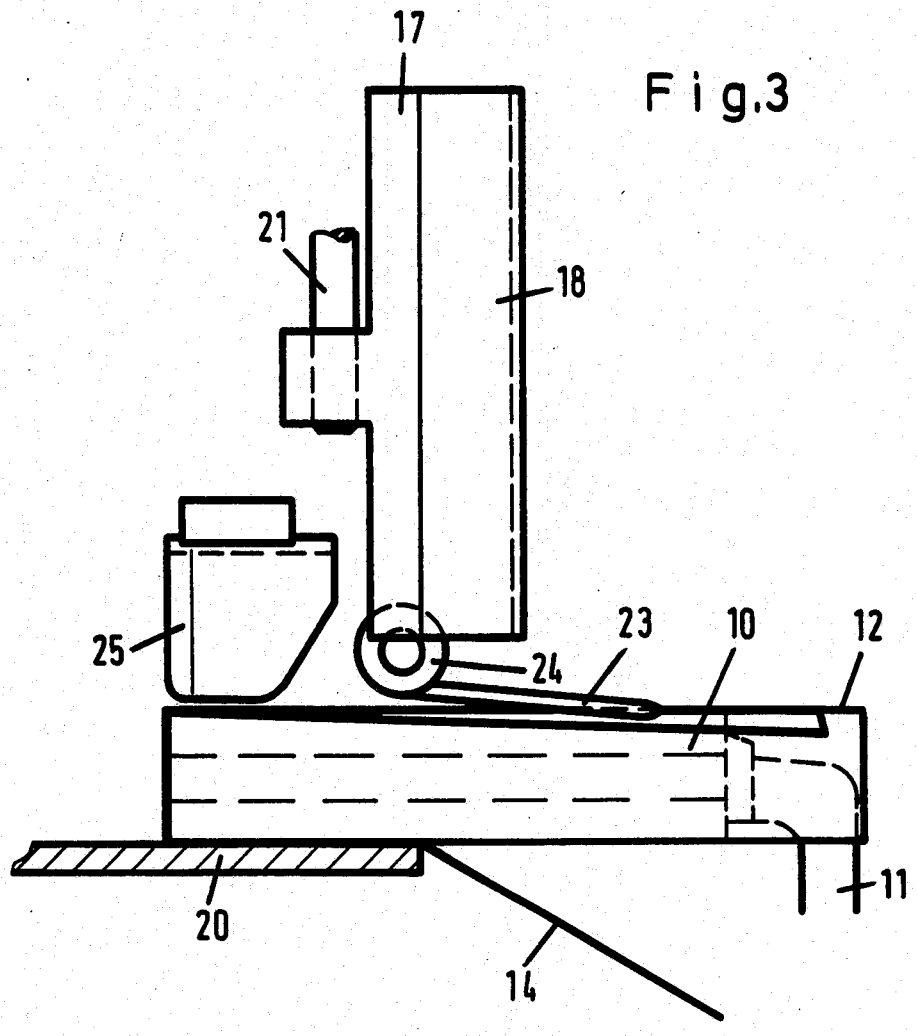
FIG. 3 is a view similar to FIG. 1, FIG. 3 depicting an intermediate stage of the packaging process performed with the apparatus of FIG. 1.
Figure 4:
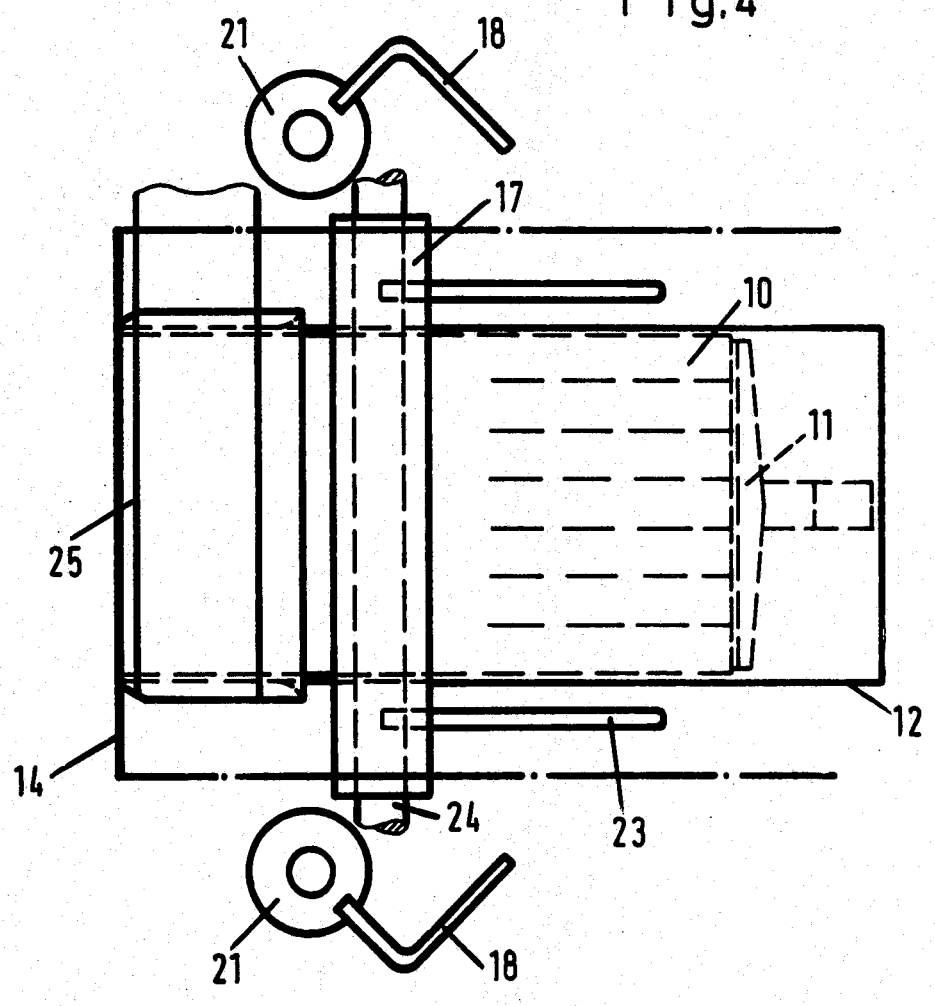
FIG. 4 is a view similar to FIG. 2 showing the apparatus in the position of FIG. 3.

With reference now to the drawing, a packaging station or apparatus in accordance with the present invention will cooperate with a conveyor system, not shown, which delivers pre-formed cigarette blocks 10 (FIGS. 3-5) to the packaging station. The cigarette blocks will be conveyed at a constant feed speed from a block forming station, by means of conveyor chain hooks and associated pusher plates 11 (FIGS. 3 and 4), into a hollow mandrel or mouthpiece 12. The mandrel 12 will be provided, on its underside, with a slot which permits the passage of the conveyor chain hooks therethrough. As will become obvious from the discussion below, the mandrels 12 are movable.

Figure 1:
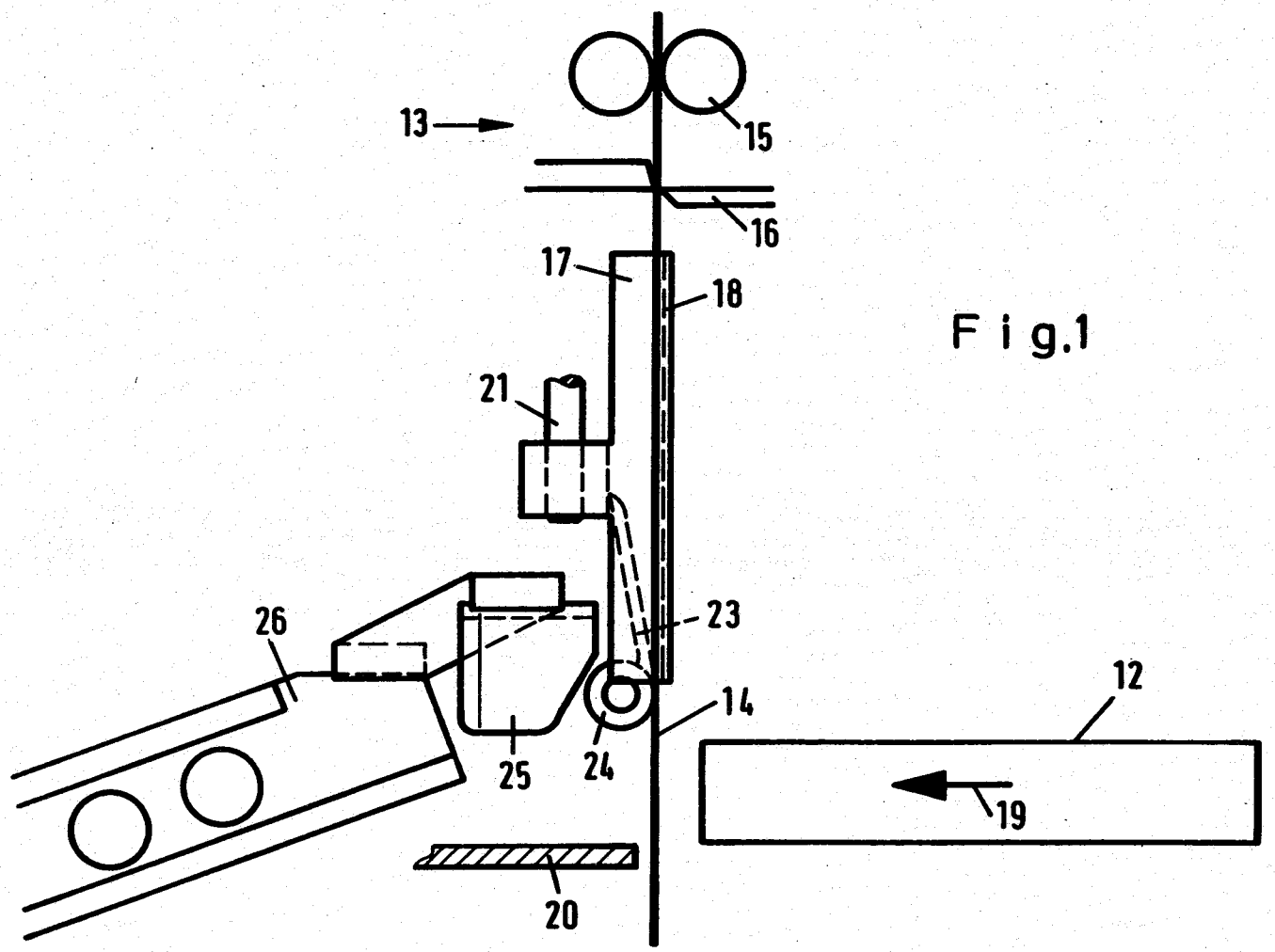
FIGURE 1 is a schematic side-elevation view, partly in section, of apparatus in accordance with a first embodiment of the present invention.
Figure 2:
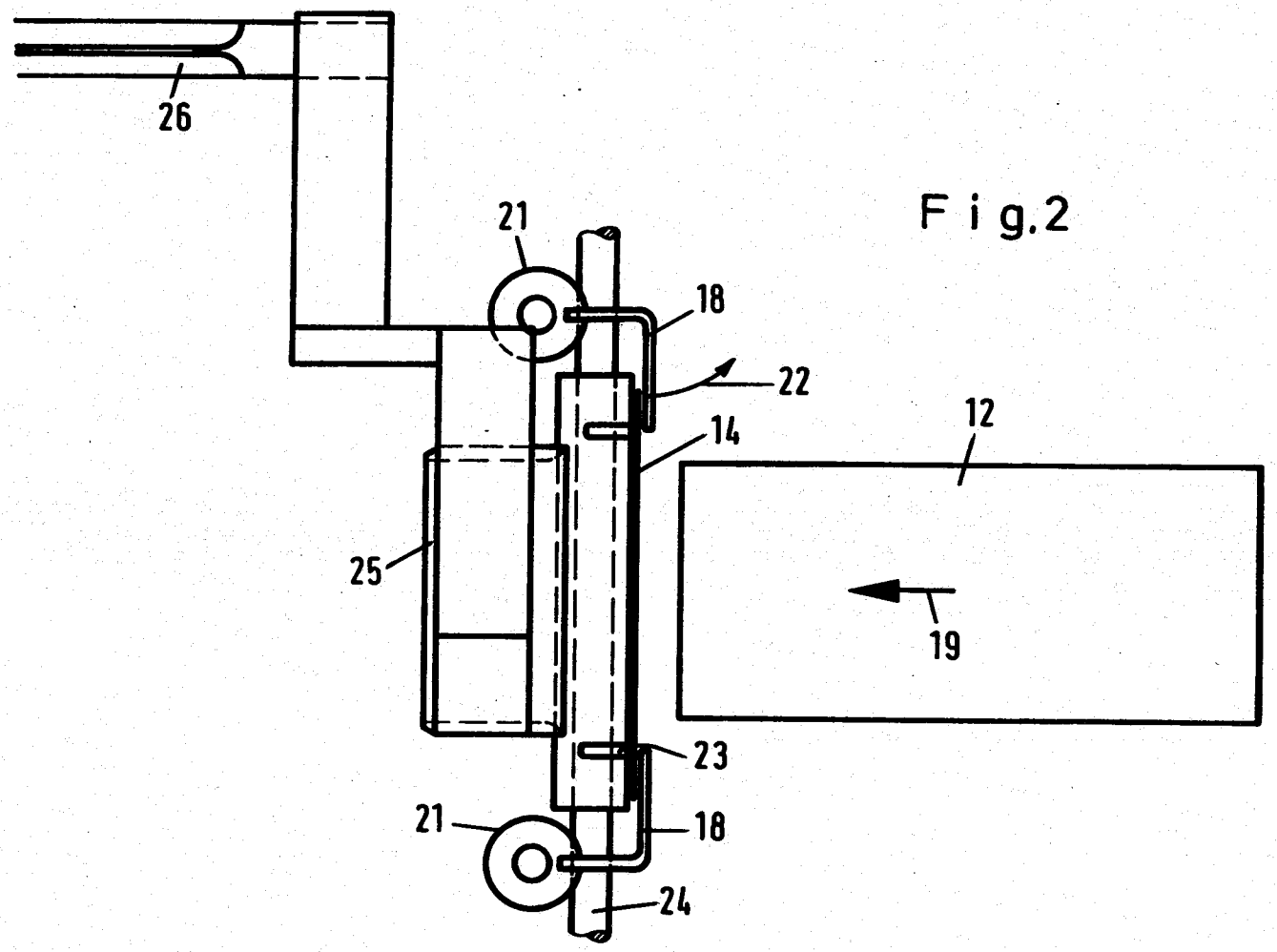
FIG. 2 is a schematic top view of the apparatus of FIG. 1.

A feed device, indicated generally at 13, for the paper 14 which is to be folded into the inner wrapper is arranged generally in front of the initial position of mandrel 12 in the conveying direction, the conveying direction being indicated in FIGS. 1 and 2 by arrow 19. The feed device 13 delivers the paper 14 from a supply reel, not shown, to a severing device 16 via feed rollers 15. The severing device 16 cuts the paper 14 into individual sheets of the appropriate length. Severing device 16 is followed, in the direction of movement of paper 14, by a stationary guide 17 which cooperates with a pair of lateral L-shaped guide elements 18. The paper guide system 17, 18 insures that the paper 14 will be fed in front of mandrel 12 in a direction which is transverse to the conveying direction 19 of the cigarette blocks 10.

The mandrel 12, as noted above, is movable. This motion is reciprocal, i.e., forward and backward along the conveying direction. By the time it travels from the position shown in FIG. 1 to that shown in FIG. 3, the mandrel 12 has reached a forward speed which is equal to the speed of the conveyor chain. This speed is maintained up to the limit of motion in the forward direction, represented in FIG. 5, whereupon the mandrel 12 is returned to its initial position of FIG. 1. The means for inparting reciprocal motion to mandrel 12 does not comprised part of the present invention, is known in the prior art and thus will not be described herein.

During movement of mandrel 12 in conveying direction 19, the leading end of the mandrel will contact the paper 14 upstream, in the direction of movement of the mandrel, of a support plate 20. The support plate 20, like mandrel 12, is provided with a slot whereby the conveyor chain hooks 11 may pass therethrough. As the movement of the mandrel continues, the paper 14 will be folded around the upper and lower edges of the leading end thereof thus generally defining the bottom of the inner wrapper which is being formed. Simultaneously with the paper 14 being folded around the lower edge of mandrel 12, by the cooperation between the mandrel and support plate 20, the paper 14 is released by the guide elements 18 which are pivoted away from the stationary guide member 17 as may be seen by joint consideration of FIGS. 2 and 4, the pivoting action being produced by means of pivotal drive devices 21. The actual folding of the "top" side of the inner wrapper results from cooperation between the moving paper 14, as it is pushed forwardly by the cigarette block 10 and mandrel 12, and a pair of arms 23. The arms 23 are arranged to either side of the mandrel 12 and are supported for pivoting motion on an axle 24. As the apparatus is depicted in the drawing, axle 24 rotates in the clockwise direction to press the paper 14 downwardly in a direction which is opposite to the direction of motion of the mandrel to the position illustrated in FIG. 3. The arms 23 prevent the free, upstream end of paper 14 from flaring upwardly as a result of its inherent resilience and thus possibly disturbing the subsequent folding operations.

Figure 5:
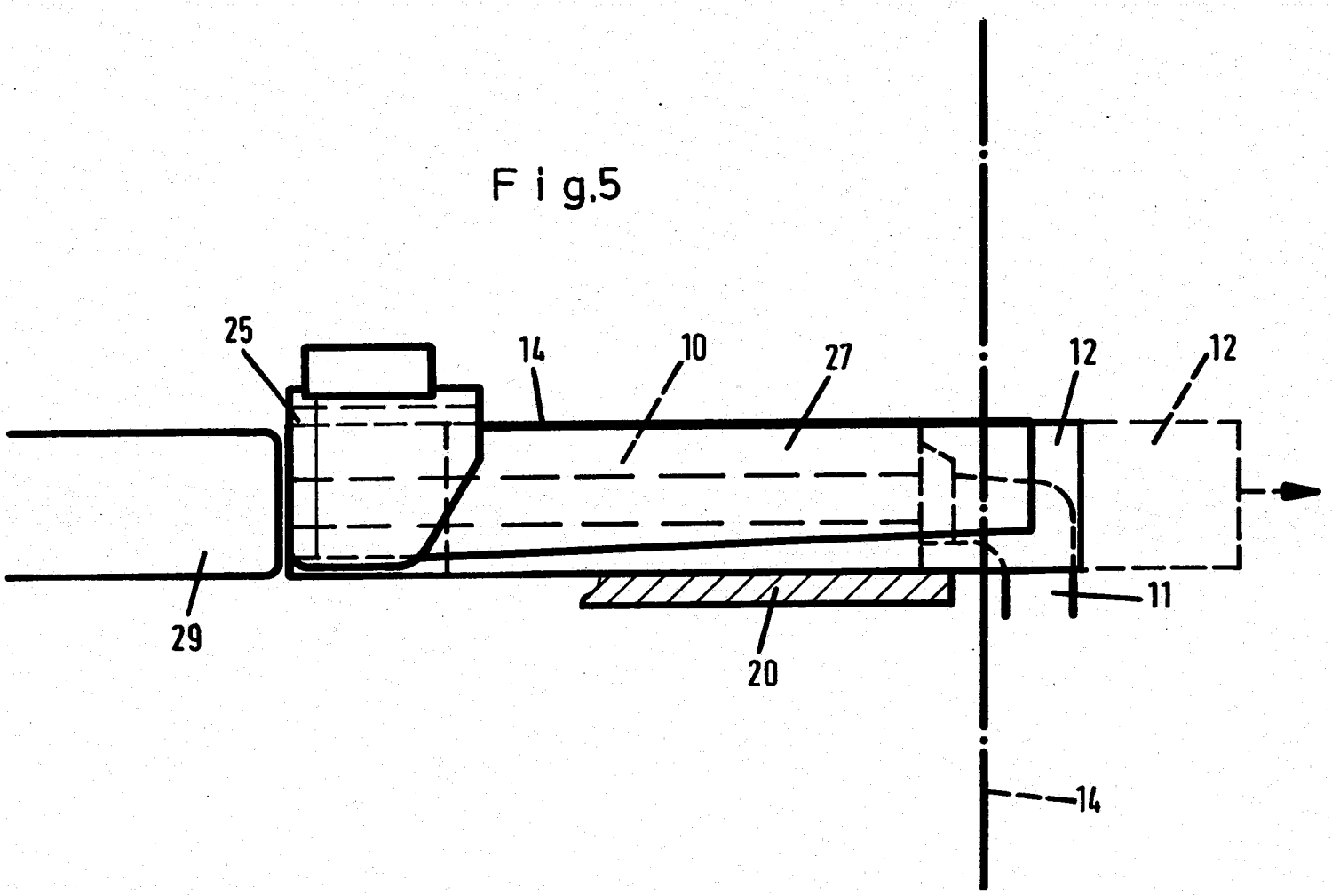
FIG. 5 is a partial view, taken in the same direction as FIGS. 1 and 3, depicting a further stage in the package forming procedure of the present invention.

Apparatus in accordance with the invention is also provided with a U-shaped folding element 25 which is mounted on a slide 26. As may be seen from comparison of FIGS. 1 and 5, the slide 26 and thus the folding element 25 is arranged so as to be displacable in oblique direction relative to the conveying direction 19, the direction of displacement being determined by a guide (not shown). When the folding element 25 is in its initial position, as depicted in FIG. 1, it is located in front of and above the mandrel 12 in conveying direction 19. When the mandrel 12 reaches the position shown in FIG. 3, the folding element 25 begins to move obliquely downwardly. During this movement, element 25 progressively engages the paper 14 which extends outwardly beyond both sides of the top of mandrel 12. The component of speed of folding element 25 in conveying direction 19 is equal to the conveyor speed and consequently is equal to the speed of mandrel 12. The oblique movement of folding element 25 continues until the element has reached the position where it essentially overlaps the mandrel, i.e., the folding element 25 is positioned as shown in FIG. 5. The folding element 25 remains in the position of FIG. 5 until the cigarette block 10, together with the paper 14, has passed between the two arms of the U-shaped folding element. Thus, referring jointly to FIGS. 5 and 6, inner sidewalls 27 of the wrapper will be folded in a direction substantially transverse to the wide "top" side. During the time the cigarette block is passing between the arms of the folding element 25, the mandrel 12 will be returned to its initial position of FIG. 1. After the inner side walls 27 have been folded, the folding element 25 will be returned to its initial position, also shown in FIG. 1.

The synchronized movements of the mandrel 12, folding element 25, paper guide elements 18 and arms 23 are controlled by means of a suitably designed cam and gear arrangement which are coupled to a common drive.

The downward folding of the inner sidewalls 27 of the wrapper will result in the formation of tabs 28 which extend outwardly from the sidewalls 27. These tabs ar subsequently folded inwardly toward the sidewalls 27 by respective folding tappets or plates 29 which are arranged laterally on each side of the moving, partially wrapped cigarette block. Subsequently, the outer side wall regions of the wrapper, indicated at 30 in FIG. 6, are folded upwardly in the conventional manner by apparatus located downstream of the plates 29, this apparatus being part of the prior art and thus not being shown herein.

Figure 6:
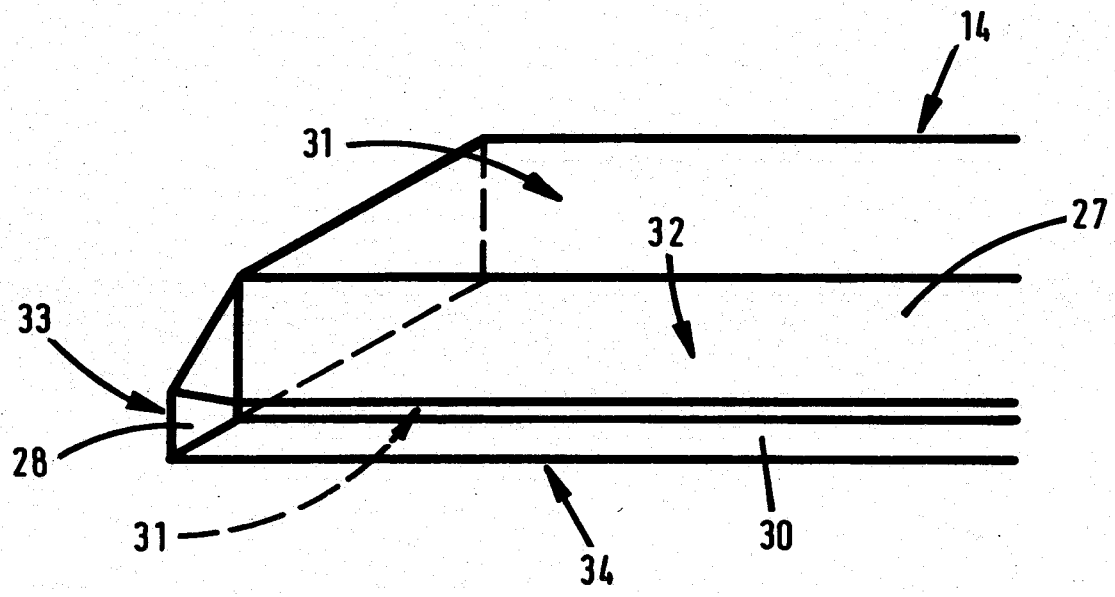
FIG. 6 is a diagramatic showing of the sequence of operations performed in accordance with the method of the present invention.

The procedure performed with the above-described apparatus may clearly be seen from FIG. 6. First, the paper 14 is folded the direction of arrows 31 with the "bottom" side, as the package is depicted in the figure, being produced by cooperation between the mandrel 12 and plate 20 and the "top" side being produced through the action of the arms 23. Next, the inner side walls 27 are folded in direction 32 through the action of the U-shaped folding element 25. Next, the tabs 28 are folded in direction 33 by cooperation between the moving cigarette block and the side plates 29. Finally, the outer side walls 30 of the wrapper are folded in direction 34.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In an apparatus for folding sheet material into a package having a rectangular cross-section with at least one closed end, the apparatus conveying an object about which the package is to be formed continuously along a linear path, the sheet material being delivered into said path in a direction generally transverse thereto, the improvement comprising:

first means for folding the sheet material about the object so that portions of the sheet material respectively lie in a first plane generally parallel to one end of the object and in second and third planes generally parallel to a first pair of oppositely disposed sides of the object, said sides of said first pair being generally transverse to and extending from said one end, further portions of the sheet material extending outwardly generally in said first, second and third planes beyond planes defined by a second pair of oppositely disposed sides of the object;

generally U-shaped means for folding said outwardly extending sheet material in said second plane into planes generally parallel to said second pair of sides of the object to define a first pair of package side walls, said U-shaped folding means being obliquely movable relative to the object and initially acting upon a region of said sheet material adjacent the leading end of the object as said U-shaped folding means travels with the object and in an oblique direction from a first position adjacent said second plane to a second position adjacent said third plane, said U-shaped folding means being retained in said second position while motion of the object continues whereby said outwardly extending sheet material from said second plane will be folded along the length the object, the folding of the sheet material into said planes resulting in tabs which extend outwardly with respect to said sides of said second pair and from said one end; and second means for folding said tabs backwardly against said side walls of said first pair of side walls was movement of said object continues.

2. The apparatus of claim 1 wherein the package is an inner wrapper and wherein said object is a mandrel containing a block of cigarettes, said mandrel being reciprocal whereby it may be withdrawn from the end of the package disposed oppositely to said one end during the formation the package.

3. The apparatus of claim 2 further comprising:

stationary guide means for directing the sheet material toward the path of motion of the block of cigarettes; and movable guide means for cooperating with said stationary guide means to support the sheet material, said movable guide means being positioned in front of said U-shaped folding means in the direction of movement of the cigarette block and being pivotal to a release position subsequent to the mandrel contacting the sheet material.

4. The apparatus of claim 3 wherein said stationary guide means defines a planar guide surface and wherein said movable guide means includes a pair of L-shaped members which are pivotal in opposite directions.

5. The apparatus of claim 2 wherein said first folding means includes means for urging a portion of the sheet material against said mandrel t thereby position the said portion generally in said second plane, said portion extending beyond a lateral edge of said one end as defined by the mandrel.

6. The apparatus of claim 5 wherein said means for urging includes a pair of movable arms, said arms being pivotable about an axis which is transverse to the direction of motion of the cigarette block, one of said arms being located to cooperate with the sheet material which extends beyond each side of the mandrel and to act on the sheet material prior to its being contacted by said U-shaped folding means.

7. The apparatus of claim 4 wherein said first folding means includes means for urging a portion of the sheet material against said mandrel to thereby position the said portion generally in said second plane, said portion extending beyond a lateral edge of said one end as defined by the mandrel.

8. The apparatus of claim 7 wherein said means for urging includes a pair of movable arms, said arms being pivotable about an axis which is transverse to the direction of motion of the cigarette block, one of said arms being located to cooperate with the sheet material which extends beyond each side of the mandrel and to act on the sheet material prior to its being contacted by said U-shaped folding means.

9. The apparatus of claim 8 wherein said first folding means further includes:

a stationary plate, movement of said mandrel relative to and in close proximity to said plate causing the sheet material to be folded into said third plane.

10. A method for the formation of an inner wrapper of a cigarette package from a sheet of flexible packaging material comprising the steps of:

contacting a central region of the sheet of packaging material with a moving hollow mandrel to define a first wrapper end, the mandrel having a size and shape commensurate with at least a portion of a cigarette block to be wrapper;

folding the sheet material generally transversely with respect to the said first end into two generally parallel planes to thereby define a generally U-shaped partial inner wrapper;

folding the sheet material from that portion of one of said parallel planes which extends beyond that portion which overlies the mandrel gradually in the direction of the other of said parallel planes to form a leading edge region of a pair of oppositely disposed inner wrapper side walls, said side wall leading edge portions being in part generally transverse to said planes;

continuing to fold from said formed inner side wall leading edge portions toward the opposite edge of the wrapper to complete the inner walls, the formation of said inner side walls producing generally laterally extending flaps at the said first end of the inner wrapper;

folding said flaps against said inner side walls; and folding outer side walls over said flaps, said outer side walls being folded from the sheet material lying in the other of said planes of said U-shaped partial inner wrapper.

* * * * *